US006634822B1

(12) United States Patent
Wang

(10) Patent No.: US 6,634,822 B1
(45) Date of Patent: Oct. 21, 2003

(54) CLEANING BRUSH

(75) Inventor: King Yuan Wang, Changhua Hsien (TW)

(73) Assignee: Yuan Mei Corp., Changhua Hsien (TW)

( * ) Notice: Subject to any disclaimer, the term of this patent is extended or adjusted under 35 U.S.C. 154(b) by 0 days.

(21) Appl. No.: 10/349,214

(22) Filed: Jan. 23, 2003

(51) Int. Cl.[7] ..... A46B 11/06

(52) U.S. Cl. ..... 401/137; 15/144.4; 15/172; 15/176.2; 15/176.3; 239/532; 239/587.1; 285/302; 401/277; 401/281; 401/289; 403/351

(58) Field of Search ..... 401/137, 277, 401/281, 280, 270, 289; 15/144.1, 144.4, 144.3, 172, 176.2, 176.3; 239/532, 165, 587.1; 403/351; 285/302, 104, 105

(56) References Cited

U.S. PATENT DOCUMENTS 1,373,369 A * 3/1921 Trial ..... 401/137
5,336,012 A * 8/1994 Newville ..... 401/289
5,584,594 A * 12/1996 Newville ..... 401/289
6,164,496 A * 12/2000 Gregory ..... 239/316 X
6,336,764 B1 * 1/2002 Liu ..... 401/289

* cited by examiner

*Primary Examiner*—Gregory L. Huson
*Assistant Examiner*—Kathleen J. Prunner
(74) *Attorney, Agent, or Firm*—Troxell Law Office PLLC

(57) ABSTRACT

A cleaning brush comprises a brush embodiment, a telescopic tube, a valve assembly, a rotary connector, and a retaining sleeve wherein the brush embodiment having a threaded coupling hole disposed at the center thereof to be engaged with a threaded sleeve of the telescopic tube is provided with a through groove for a scraper strip to be adapted thereto. The valve assembly made up of a valve body, a valve sleeve and a switch sleeve is sleeve joined to an outer tube of the telescopic tube. A pivot rod of the retaining sleeve is led through a pivot hole of the rotary connector and fixedly located at a water inlet hole of the valve body thereof via ultrasonic wave or fastening agents. The rotary connector, pivotally joined to the retaining sleeve which in turn is securely fixed to the water inlet hole of the valve body, can rotate freely via the pivot rod of the retaining sleeve to adjust the position of a duct attached thereto, refraining the duct from twisting and winding up when the brush embodiment is moved into different angles for cleaning, and effectively saving a lot of time and efforts in cleaning thereof.

3 Claims, 5 Drawing Sheets

CLEANING BRUSH

BACKGROUND OF THE INVENTION

The present invention is related to a cleaning brush, comprising a brush embodiment, a telescopic tube, a valve assembly, a rotary connector, and a retaining sleeve wherein said brush embodiment having a threaded coupling hole disposed at the center thereof to be engaged with said telescopic tube is provided with a through groove for a scraper strip to be adapted thereto. Said valve assembly made up of a valve body, a valve sleeve and a switch sleeve is sleeve joined to one end said telescopic tube. Said rotary connector, pivotally joined to said retaining sleeve which in turn is securely fixed to a water inlet hole of said valve body thereof, can rotate freely thereon to adjust the position of a duct attached thereto, refraining said duct from twisting and winding up when said brush embodiment is moved into different angles for cleaning, and effectively saving a lot of time and efforts in cleaning thereof.

Please refer to FIG. 1. A conventional cleaning brush 6 is mainly made up of hollow tube 61 having a brush head 62 or sprinkler attached at the upper end and an enlarged ring flange 611 disposed at the bottom end thereof A coupling sleeve 63 equipped with an inner threaded hole 631 is sleeve joined to the bottom of said enlarged ring flange 611 for a sealing washer 64 and a switch sleeve 65 to be adapted thereto. Said switch sleeve 65 is provided with an outer threaded section 651 disposed at the upper end thereof, an inner threaded coupling hole 652 disposed at the lower section thereof, and a switch handle 653 disposed at one side thereof for controlling the discharge of water.

Please refer to FIG. 2. In assembly, said sealing washer 64 is first located at said inner threaded hole 631 thereof and abutted against said enlarged ring flange 611 thereof. The outer threaded section 651 of said switch sleeve 65 is then screw joined to the inner threaded hole 631 of said coupling sleeve 63, abutting tight said sealing washer 64 and said coupling sleeve 63 respectively against said enlarged ring flange 611 thereof. A sealing ring 66 is then located at the inner threaded coupling hole 652 of said switch sleeve 65, and a coupling end of a duct 7 is screw joined to the inner threaded coupling hole 652 of said switch sleeve 65 to complete the assembly thereof.

There are some drawbacks to such conventional cleaning brush. First, although sleeve joined to said hollow tube 61, said coupling sleeve 63 along with said sealing washer 64 is fixedly located by said switch sleeve 65 at said hollow tube 61 thereof When said brush head 62 is moved into different angles for cleaning, said coupling sleeve 63 will go therewith, unable to adjust the position of the duct 7 attached at said switch sleeve 65 thereto. Accordingly, said duct 7 is easily twisted and wound up therewith. Second, the twisted and wound-up duct 7 can uneconomically increase the efforts in cleaning due to the torsion produced therewith and inconveniently cause the interruption in cleaning for straightening out the twisted duct 7 thereof.

SUMMARY OF THE PRESENT INVENTION

It is, therefore, the primary purpose of the present invention to provide a cleaning brush, comprising a brush embodiment, a telescopic tube, a valve assembly, a rotary connector, and a retaining sleeve wherein said rotary connector, pivotally joined to said retaining sleeve which in turn is securely fixed to a water inlet hole of a valve body, can rotate freely thereon via a pivot rod of said retaining sleeve to adjust the position of a duct attached thereto, refraining said duct from twisting and winding up when said brush embodiment is moved into different angles for cleaning.

It is, therefore, the secondary purpose of the present invention to provide a cleaning brush wherein said rotary connector can straighten out the twisted duct, effectively reducing the torsion and saving a lot of time and efforts in cleaning thereof.

DETAILED DESCRIPTION OF THE PREFERRED EMBODIMENTS

Figure 1:
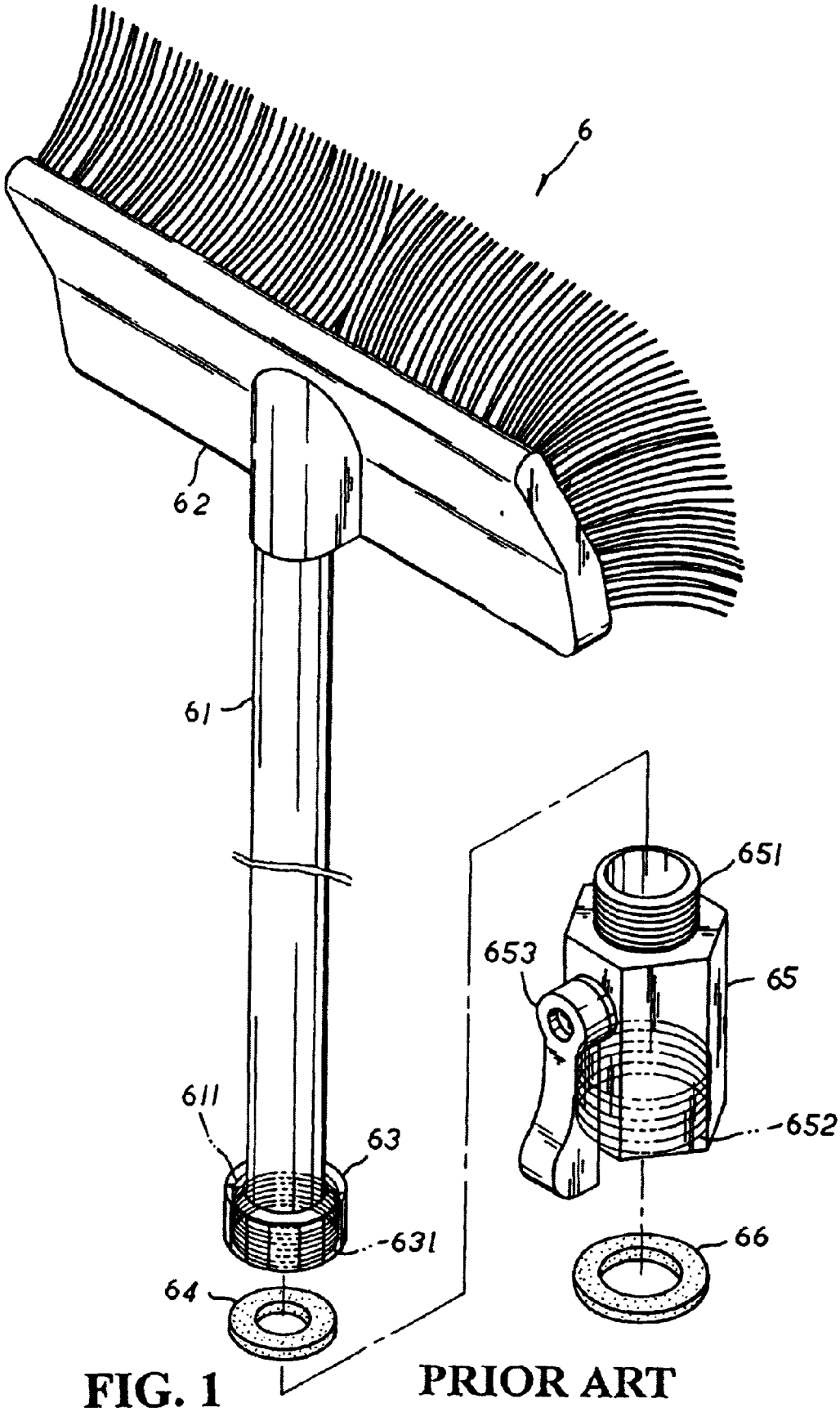
FIG. 1 PRIOR ART
FIG. 1 is a perspective exploded view of a conventional cleaning brush.
Figure 2:
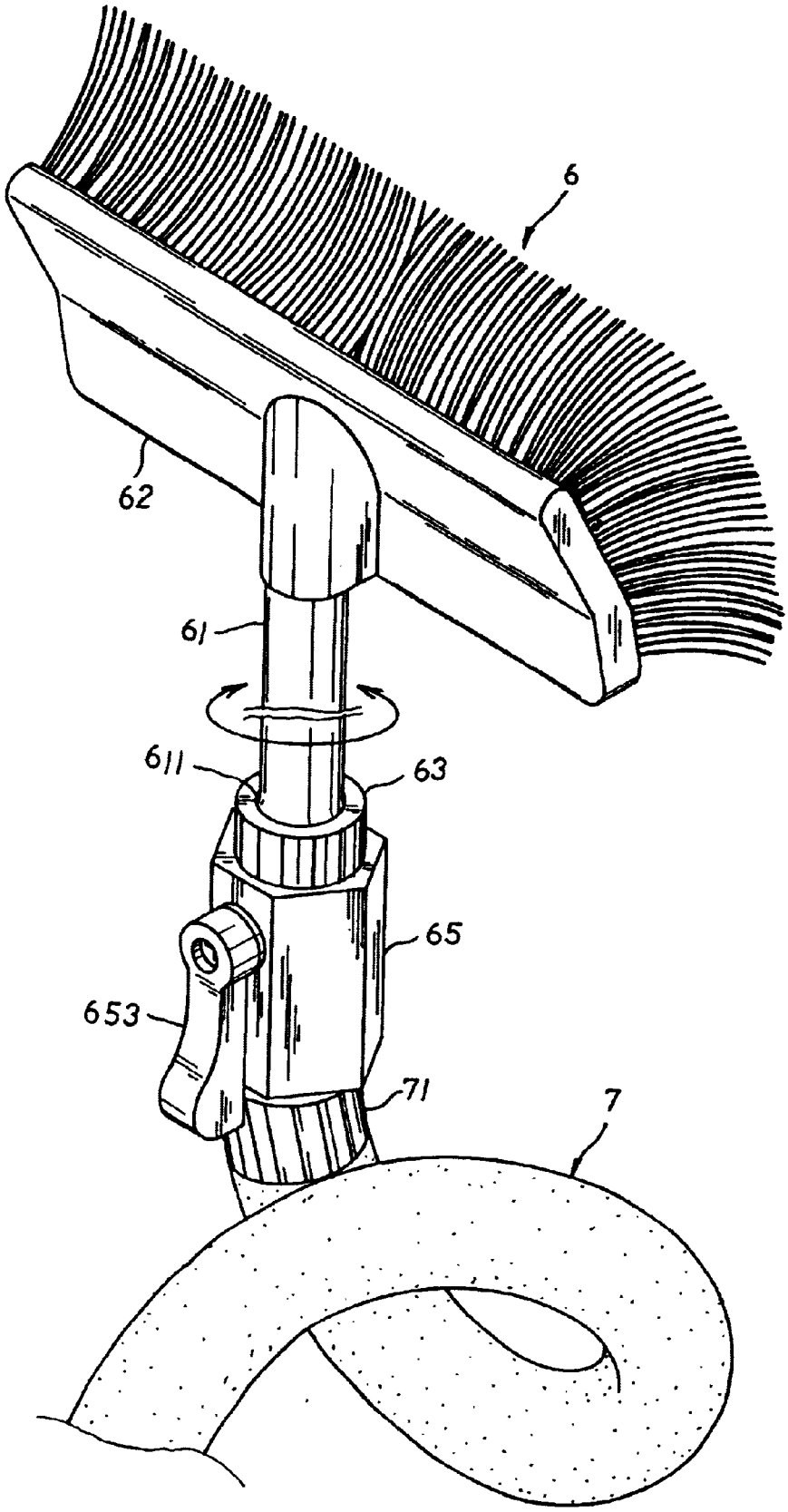
FIG. 2 PRIOR ART
FIG. 2 is a diagram showing the conventional cleaning brush in operation.
Figure 3:
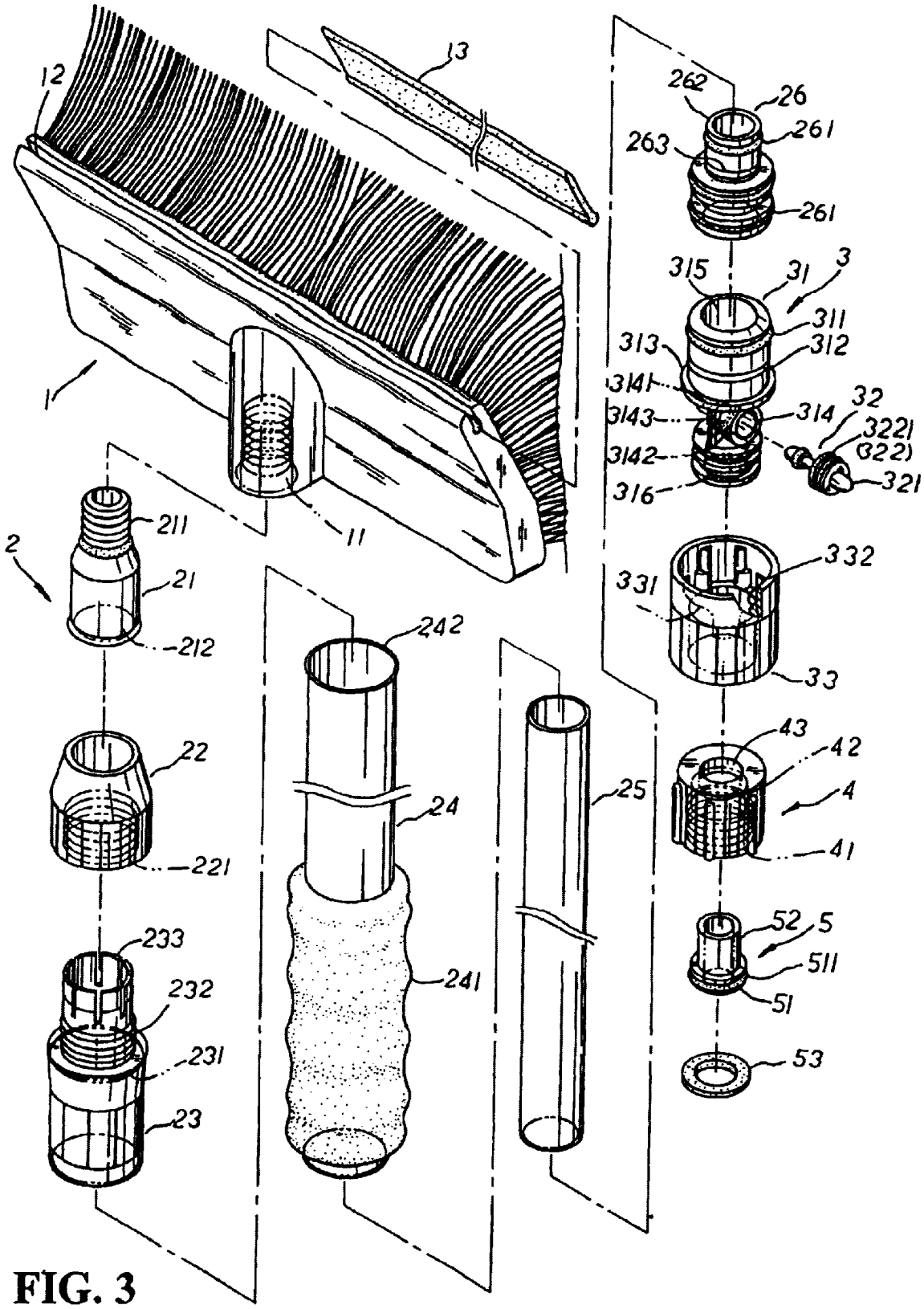
FIG. 3 is a perspective exploded view of the present invention.

Please refer to FIG. 3. The present invention is related to a cleaning brush, comprising a brush embodiment 1, a telescopic tube 2, a valve assembly 3, a rotary connector 4, and a retaining sleeve 5. The brush embodiment 1 has a threaded coupling hole 11 disposed at the center thereof, and a through groove 12 disposed at one lateral side thereof for a scraper strip 13 to be adapted thereto.

The telescopic tube 2, a hollow tube in shape, is mainly made up of a threaded sleeve 21, a locking sleeve 22, a sleeve tube 23, an outer tube 24, an inner tube 25, and a sealing sleeve 26. The threaded sleeve 21 has a threaded upper end 211 of smaller diameter, and a sleeve coupling hole 212 disposed at the other end thereof. The locking sleeve 22 has an inner threaded section 221 disposed at one end thereof with a tapered section disposed at the other end thereof. The sleeve tube 23 has an inner ring groove 231 properly disposed at the middle section thereof, a stepwise outer threaded section 232 disposed at one end thereof and a plurality of stopping teeth 233 extending upwards at top of the stepwise outer threaded section 232 thereof. The outer tube 24 with the inner tube 25 sleeve joined therein is equipped with a handle cover 241 disposed at the outer surface thereof, and a projecting ring 242 disposed at one end thereof. The sealing sleeve 26 has a plurality of sealing rings 261 disposed at the periphery thereof, a stepwise coupling tube 262 disposed at one end thereof, and an indented groove 263 disposed at the periphery of the stepwise coupling tube 262 thereof.

The valve assembly 3 is mainly made up of a valve body 31, a valve sleeve 32, and a switch sleeve 33. The valve body 31 is provided with a plurality of watertight rings 311 disposed at both the upper and lower peripheries thereof, a circular groove 312 defined properly at the upper section thereof, a stop flange 313 projecting at the middle section thereof, and a transverse retaining hole 314 properly disposed at the lower section thereof. A pair of asymmetric and crescent-shaped upper and lower water outlet orifices 3141, 3142 are disposed at the inner side of the transverse retaining hole 314 in communication with an upper water outlet hole 315 and a lower water inlet hole 316 disposed at both ends of the valve body 31 thereof respectively. The lower water outlet orifice 3142 is defined by a projecting flange 3143 adjacent to the lower water inlet hole 316 thereof. The valve sleeve 32 is provided with a pair of arc ends 321 disposed at both sides thereof, and an indented ring groove 322 disposed at one side thereof with a waterproof ring 3221 adapted thereto. The switch sleeve 33 is equipped with a pair of eccentric arc facets 331 properly disposed at the inner side thereof, and a guide slope 332 extending at the top of each eccentric arc facet 331 thereof.

The rotary connector 4 is equipped with an inner threaded hole 41 disposed at the lower section thereof, and a sleeve hole 42 and a pivot hole 43 disposed in stepwise at the top of the inner threaded hole 41 thereof The retaining sleeve 5 has a sleeve seat 51 with a watertight ring 511 adapted thereto disposed at one end thereof, and a pivot rod 52 projecting at the other end thereof. A sealing washer 53 is adapted to be abutted against the sleeve seat 51 thereof.

Figure 4:
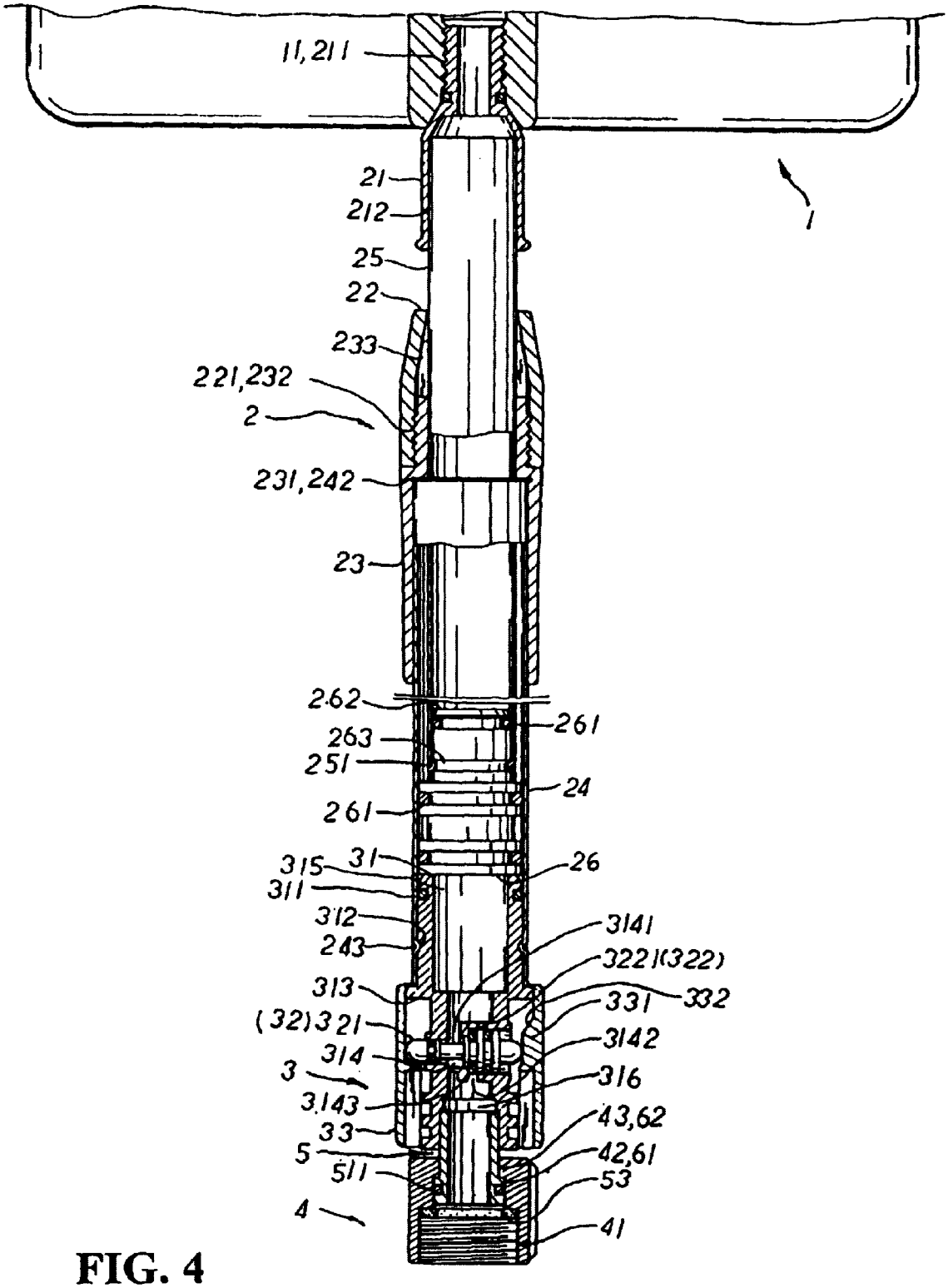
FIG. 4 is a sectional view of the present invention in assembly.

Please refer to FIG. 4. In assembly, the scraper strip 13 is first adapted to the through groove 12 of the brush embodiment 1. The upper end of the outer tube 24 is led upwards and sleeve joined to the inner side of the sleeve tube 23 with the projecting ring 242 thereof fixedly engaged with the inner ring groove 231 thereof. The stepwise coupling tube 262 of the sealing sleeve 26 is sleeve joined to one end of the inner tube 25 and located therein via the indented groove 263 engaging with a plurality of punched retaining dots 251 disposed at the lower section of the inner tube 25 thereof. The inner tube 25 is then led through one end of the outer tube 24 to come out at the other end thereof. The locking sleeve 22 is sleeve joined to the upper end of the inner tube 25 with the inner threaded section 221 thereof screw joined to the outer threaded section 232 of the sleeve tube 23, pressing the stopping teeth 233 to clamp tightly against the inner tube 25 for secure location thereof. The upper end of the inner tube 25 is then fixedly engaged with the coupling hole 212 of the threaded sleeve to complete the assembly of the telescopic tube 2 thereof.

The valve body 31 is led through the lower end of the outer tube 24 and securely sleeve joined therein via the circular groove 312 thereof engaged with a plurality of punched locating dots 243 disposed at the lower section of the outer tube 24 thereof. The valve sleeve 32 is then led through one side of the transverse retaining hole 314 of the valve body with the waterproof ring 3221 abutting against the projecting flange 3143 and the arc end 321 coming out of the other side of the transverse retaining hole 314 to seal up the lower water outlet orifice 3142. The switch sleeve 33 is sleeve joined to the lower end of said valve body 31 with the arc ends 321 of the valve sleeve 32 slid through the guide slope 332 thereof to be abutted against the arc facets 331 of the switch sleeve 33 thereof. The pivot rod 52 of the retaining sleeve 5 is led through the pivot hole 43 of the rotary connector 4 with the sleeve seat 51 thereof engaged with the sleeve hole 42 thereof. The pivot rod 52 is then led to the water inlet hole 316 of the valve body 31 and securely fixed thereto via ultrasonic wave or fastening agents thereof. The threaded upper end 211 of the threaded sleeve 21 thereof is finally screw joined to the threaded coupling hole 11 of the brush embodiment 1 to complete the assembly of the present invention as shown in FIG. 4.

Figure 5:
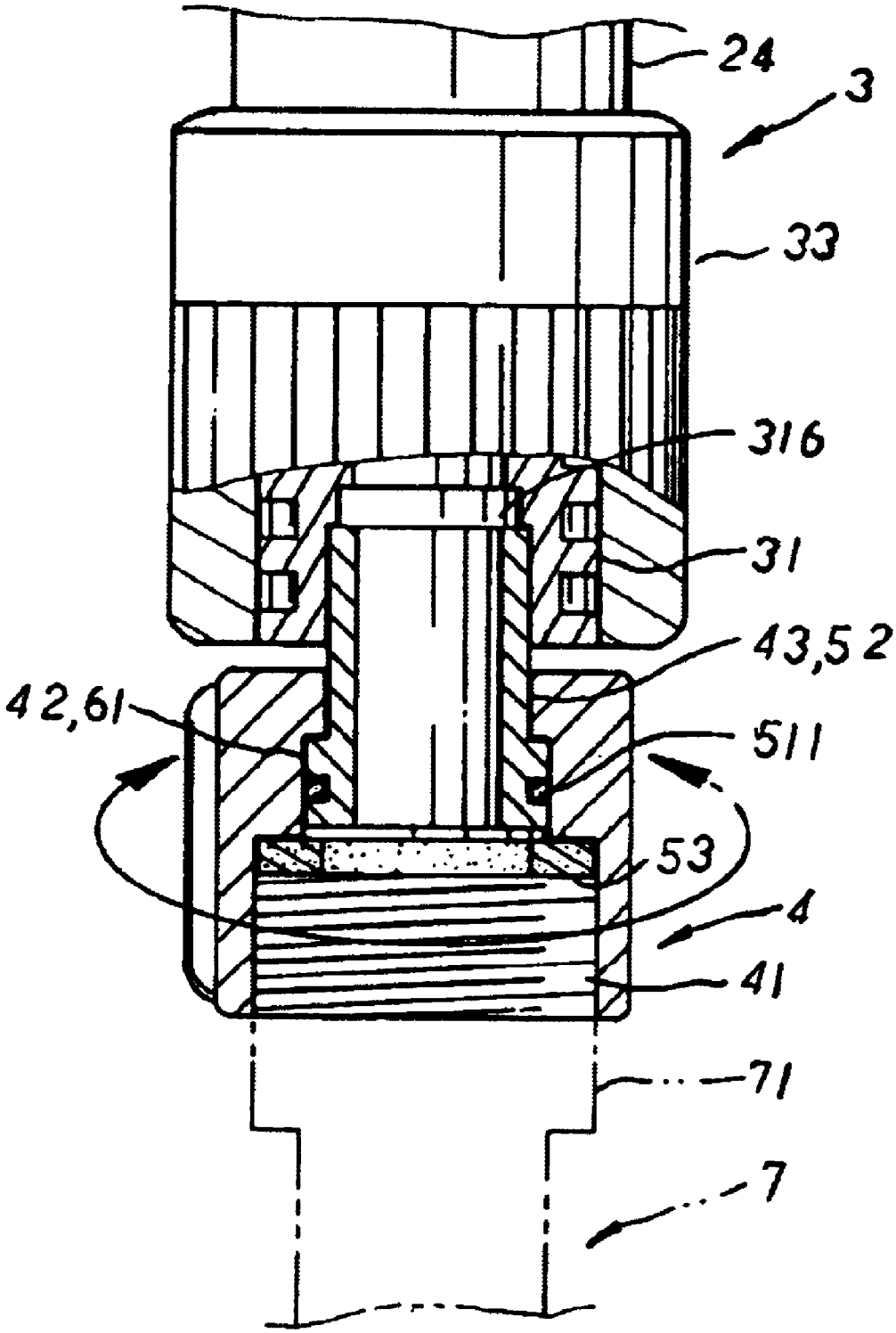
FIG. 5 is a partially sectional view of the present invention in operation.

Please refer to FIG. 5. A duct 7 is adapted and fixedly engaged with the rotary connector 4 via a coupling end 71 joined by screws to the inner threaded hole 41 of the rotary connector 4. The rotary connector 4, pivotally joined to the retaining sleeve 5 which in turn is securely fixed to the water inlet hole 316 of the valve body 31, can rotate freely via the pivot rod 52 of said retaining sleeve 5 to adjust and straighten out the duct 7 when the brush embodiment 1 is moved into different angles for cleaning thereof, refraining the duct 7 from twisting and winding up therewith and effectively saving a lot of time and efforts in cleaning thereof.

What is claimed is:

1. A cleaning brush, comprising a brush embodiment, a telescopic tube, a valve assembly, a rotary connector, and a retaining sleeve wherein said brush embodiment has a threaded coupling hole disposed at the center thereof, and a through groove disposed at one lateral side thereof for a scraper strip to be adapted thereto; said cleaning brush being characterized by that:

said telescopic tube, a hollow tube in shape, mainly made up of a threaded sleeve, a locking sleeve, a sleeve tube, an outer tube, an inner tube, and a sealing sleeve wherein said threaded sleeve having a threaded upper end of smaller diameter, and a sleeve coupling hole disposed at the other end thereof; said locking sleeve having an inner threaded section disposed at one end thereof with a tapered section disposed at the other end thereof; said sleeve tube having an inner ring groove properly disposed at the middle section thereof, a stepwise outer threaded section disposed at one end thereof and a plurality of stopping teeth extending upwards at a top of said stepwise outer threaded section thereof; said outer tube with said inner tube sleeve joined therein having a handle cover disposed at the outer surface thereof, and a projecting ring disposed at one end thereof; said sealing sleeve having a plurality of sealing rings disposed at the periphery thereof, a stepwise coupling tube disposed at one end thereof, and an indented groove disposed at the periphery of said stepwise coupling tube thereof;

said valve assembly mainly made up of a valve body, a valve sleeve, and a switch sleeve wherein said valve body having a plurality of watertight rings disposed at both an upper and a lower periphery thereof, a circular groove defined properly at the upper section thereof, a stop flange projecting at the middle section thereof, and a transverse retaining hole properly disposed at the lower section thereof; a pair of asymmetric upper and lower water outlet orifices being disposed at the inner side of said transverse retaining hole in communication with an upper water outlet hole and a lower water inlet hole disposed at both ends of said valve body thereof respectively; said lower water outlet orifice being defined by a projecting flange adjacent to said lower water inlet hole thereof; said valve sleeve having a pair of arc ends disposed at both sides thereof, and an indented ring groove disposed at one side thereof with a waterproof ring adapted thereto; said switch sleeve being equipped with a pair of eccentric arc facets properly disposed at the inner side thereof, and a guide slope extending at a top of each said eccentric arc facet thereof;

said rotary connector having an inner threaded hole disposed at the lower section thereof with a sleeve hole and a pivot hole disposed in stepwise at the top of said inner threaded hole thereof;

said retaining sleeve having a sleeve seat with a watertight ring adapted thereto disposed at one end thereof, and a pivot rod projecting at the other end thereof; a sealing washer being adapted to be abutted against said sleeve seat thereof;

in assembly, said brush embodiment having said scraper strip adapted thereto is screw joined to the threaded sleeve of said telescopic tube, and said valve assembly is sleeve joined to one end of the outer tube of said telescopic tube; the pivot rod of said retaining sleeve is led through the pivot hole of said rotary connector and fixedly located at the lower water inlet hole of said valve body thereof; a duct is then fixedly screw joined to the inner threaded hole of said rotary connector to complete the assembly thereof;

whereby, said rotary connector, pivotally joined to said retaining sleeve which in turn is securely fixed to the lower water inlet hole of said valve body, can rotate freely via the pivot rod of said retaining sleeve to adjust and straighten out said duct thereof when said brush embodiment is moved into different angles for cleaning thereof, refraining said duct from twisting and winding up therewith, and effectively saving a lot of time and efforts in cleaning thereof.

2. The cleaning brush as claimed in claim 1 wherein the pivot rod of said retaining sleeve is led to the lower water inlet hole of said valve body and fixedly located thereto via ultrasonic wave or fastening agents thereof.

3. A cleaning brush as claimed in claim 1 wherein said pivot rod of said retaining sleeve extends upward at one end of said retaining sleeve.

* * * * *